United States Patent [19]

Tamba et al.

[11] Patent Number: 4,762,098

[45] Date of Patent: Aug. 9, 1988

[54] LUBRICATING DEVICE FOR OVERHEAD VALVE ENGINE

[75] Inventors: Shinichi Tamba, Kakogawa; Hitoshi Yamamoto, Kako; Akihito Shimizu, Kobe, all of Japan

[73] Assignee: Kawasaki Jukogyo Kabushiki Kaisha, Kobe, Japan

[21] Appl. No.: 79,028

[22] Filed: Jul. 29, 1987

[30] Foreign Application Priority Data

Aug. 8, 1986 [JP] Japan ..... 61-187091

[51] Int. Cl.[4] ..... F01M 1/06

[52] U.S. Cl. ..... 123/90.33; 123/90.38

[58] Field of Search ..... 123/90.33, 90.38, 196 M

[56] References Cited

U.S. PATENT DOCUMENTS

| | | | |
|---|---|---|---|
| 3,824,973 | 7/1974 | Harhaus | 123/90.38 |
| 4,404,936 | 9/1983 | Tatebe et al. | 123/90.38 |
| 4,512,298 | 4/1985 | Hayashi | 123/196 R |
| 4,563,986 | 1/1986 | Nakano | 123/90.38 |
| 4,601,267 | 7/1986 | Kronich | 123/90.33 |

FOREIGN PATENT DOCUMENTS 59-150912 8/1984 Japan .

*Primary Examiner*—E. Rollins Cross

[57] ABSTRACT

A lubricating device for an overhead valve engine having a rocker arm chamber provided with a valve gear, a crank chamber provided with a valve driving gear, and valve drive push rods disposed between the valve gear and the valve driving gear. Provided are paths respectively communicating aforesaid crank chamber to aforesaid rocker arm chamber, aforesaid rocker arm chamber to aforesaid push rod chamber, and the bottom of aforesaid push rod chamber to aforesaid crank chamber through a bearing portion on a power takeoff side, or the bottom of aforesaid push rod chamber is communicated to aforesaid bearing portion of aforesaid power takeoff side with an outlet for breather gas in aforesaid push rod chamber.

4 Claims, 1 Drawing Sheet

LUBRICATING DEVICE FOR OVERHEAD VALVE ENGINE

FIELD OF THE INVENTION AND RELATED ART STATEMENT

This invention relates to a lubricating device for an overhead valve (OHV) engine comprising a rocker arm chamber provided with a valve gear, a crank chamber with a valve driving gear, and valve drive push rods disposed between the valve gear and the valve driving gear.

In the conventional OHV engine of the aforesaid type, an outlet for breather gas is generally disposed on the side wall of the rocker arm chamber, thus resulting in the small volume of the rocker arm chamber as well as a failure of sufficient oil separation. To cope with the above problem, the breather chamber is required to be separately disposed at a part of the space in the rocker arm chamber or outside the side wall, which induces a complicated structure and an expensive cost. An alternative method wherein lubricating oil is gravitationally supplied to bearing portions of the crank shaft causes the PTO side (power takeoff side) to be less lubricated, especially in the overhung crank type if adopted.

OBJECT AND SUMMARY OF THE INVENTION

It is the object of the invention to provide a lubricating device for an OHV engine with improved lubrication of bearing portions of a crank shaft by way of a sufficient oil separation, without a separate breather chamber. It is also the object of the invention to eliminate additional cost due to the provision of an extra breather chamber.

The first invention is a lubricating device for an overhead valve engine comprising a rocker arm chamber provided with a valve gear, a crank chamber provided with a valve driving gear, and valve drive push rods disposed between the valve gear and the valve driving gear, in which are provided paths respectively communicating the crank chamber to the rocker arm chamber, the rocker arm chamber to the push rod chamber, and the bottom of the push rod chamber to the crank chamber through a bearing portion on the power takeoff side.

The second invention is a lubricating device for an overhead valve engine comprising a rocker arm chamber provided with a valve gear, a crank chamber provided with a valve driving gear, and valve drive push rods disposed between the valve gear and the valve driving gear, in which are provided paths respectively communicating the crank chamber to the rocker arm chamber, the rocker arm chamber to the push rod chamber, and the bottom of the push rod chamber to a bearing portion on the power takeoff side, and also an outlet for breather gas in the push rod chamber.

In the push rod chamber communicated to the rocker arm chamber, a sufficient oil separation is carried out to feed the liquefied lubricating oil to the bearing portions of the crank shaft. In addition, only the breather gas completely separated from oil and gas mixture is discharged through a breather gas outlet provided in the push rod chamber.

BRIEF DESCRIPTION OF THE DRAWING

In the accompanying drawing, there is shown an illustrative embodiment of the invention from which these and other of the objectives, novel features and advantages will be readily apparent.

Figure 1:
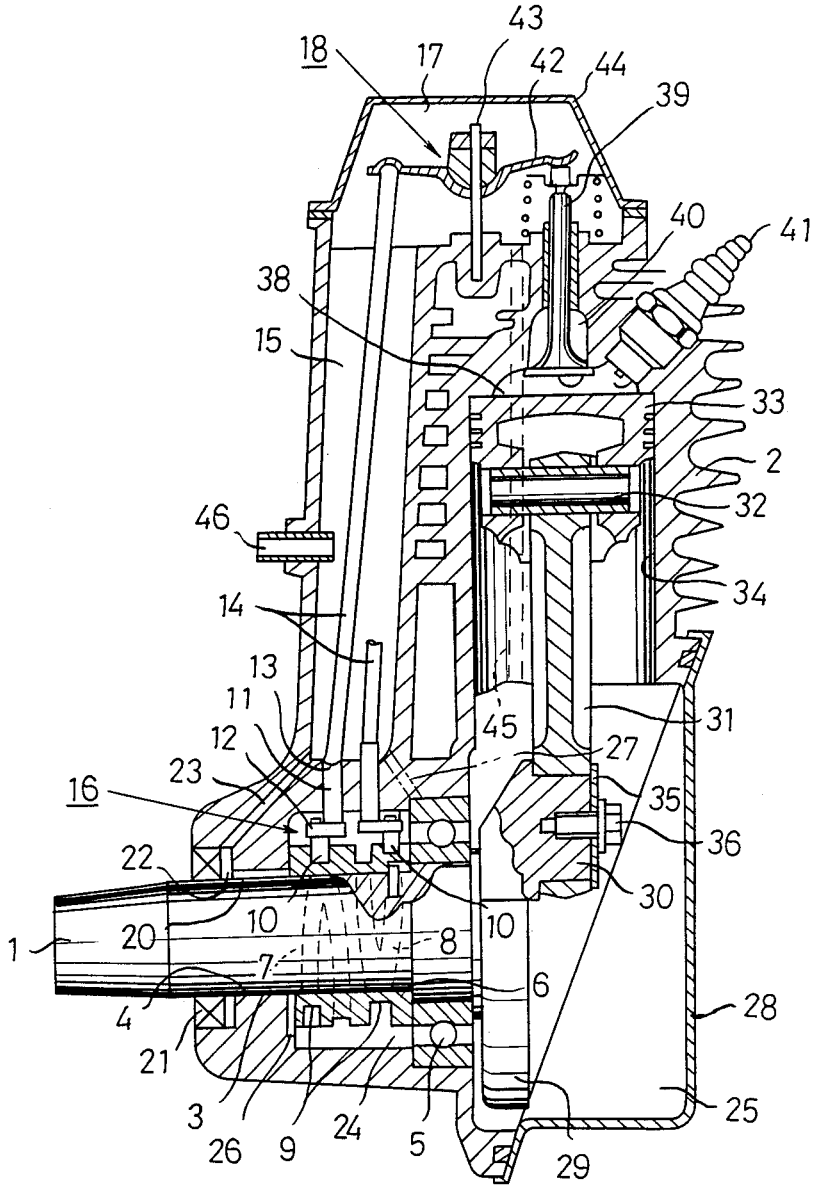
FIG. 1 is a vertical sectional view of an overhung crank type engine according to the invention.

DETAILED DESCRIPTION OF THE PREFERRED EMBODIMENT.

In FIG. 1, numerals 1 and 2 respectively are an overhung type crank shaft and a cylinder block. A journal portion 3 of the crank shaft 1 is rotatably supported by a bearing bush 4 and a ball bearing 5 provided in the cylinder block 2 and a cam ring 6 is securely fixed on the journal 3 between the bush 4 and the bearing 5. The cam ring 6 is provided with two grooves 7 and 8 around the crank shaft 1, each having such a cross shape as X returning back to a starting point in two turns on the outer circumference thereof. The roots of the grooves 7 and 8 are formed as cam faces 9, and sliders 10 fitting into the grooves 7 and 8 are brought into contact with the cam faces 9. The sliders 10 are securely or rotatably mounted on the tip ends of arms 12 disposed at the lower ends of cylindrical tappets 11. The tappets 11 slidably and rotatably supported in holes vertically provided in the cylinder block 2 are brought into engagement with valve drive push rods 14 at seats 13 of the upper ends thereof. The push rods 14, each for intake and exhaust, extend upwards from the portion engaging with the tappets 11 in a push rod chamber 15. With the invention, a valve driving gear 16 consisting of the cam ring 6 and the tappets 11 is connected to a valve gear 18 in a rocker arm chamber 17 (described later), through the push rods 14.

On the upper part of the inner surface of the bearing bush 4, a groove 20 is provided parallel to the axis of the crank shaft 1. The left end of the groove 20 opens to an annular oil reservior 22 between the bush 4 and an oil seal 21, and the oil reservior 22 is communicated to the bottom of the push rod chamber 15 through a path 23, while the right end opens to an oil reservior 24 around the cam ring 6 through a small clearance between the bush 4 and the end surface of the cam ring 6. The oil reservior 24 is communicated to a crank chamber 25 through the ball bearing 5. Numeral 26 is a cutout on the lower part of the right side surface of the bush 4. The cutout 26 opens to the oil reservior 24 at the lower end thereof, thus fully communicating the lower clearance between the bush 4 and the journal 3 to the oil reservior 24 through the cutout 26. If another bush is used in place of the ball bearing 5, a path 27 can be provided to supply the bush with lubricating oil.

The crank shaft 1 is provided with a crank arm 29 and a crank pin 30 at the right end thereof, and the crank pin 30 is connected to a piston 33 through a connecting rod 31 and a piston pin 32, and the piston 33 is slidable against a cylinder bore 34. Numerals 35, 36 and 28 respectively are a washer, a bolt for fixing the washer and a cover. A combustion chamber 38 located above the piston 33 is communicated to an exhaust port 40 through an exhaust valve 39 and to an intake port through an intake valve (both not shown). Numeral 41 is a spark plug. A rocker arm 42 engages with the upper end of the exhaust valve 39 at one end thereof and with the push rod 14 at the other end. Numerals 43 and 44 are respectively a pivot shaft (strut) for supporting the rocker arm 42 and a rocker cover. The rocker arm chamber 17 covered by the rocker cover 44 is communicated to the crank chamber 25 through a vent hole 45 provided in the cylinder block 2. The push rod chamber 15 opens to the bottom of the rocker arm chamber 17 at the upper end thereof. A breather gas outlet 46, provided in the side wall of the push rod chamber 15 in the vicinity of the bottom thereof, is connected to a clean side of an air cleaner through piping (both not shown).

From now on, the operation is described as follows: In the operation of the engine, lubricating oil in the bottom of the crank chamber 25 has been stirred by the crank arm 29 etc., resulting in the crank chamber 25 filled with lubricating oil mist (including blowby gas). Rotation of the crank shaft 1 moves up and down the piston 33, and the pumping action of the piston 33 vents the aforesaid mist into the rocker arm chamber 17 through the vent hole 45 to lubricate the valve gear 18. The lubricating oil mist vented in the rocker arm chamber 17 is also forced down into the push rod chamber 15, and then separated into oil and gas so that the oil passes through the path 23 and the oil reservior 22 to lubricate the bearing bush 4 and the journal 3 of the crank shaft 1, while a fraction of the oil in the oil reservior 22 passes through the groove 20 into the chamber 24 to lubricate the cam faces 9, and returns back into the crank chamber 25 through the ball bearing 5. The blowby gas separated from the oil mist in the push rod chamber 15 is drawn into an intake system such as the clean side of the air cleaner from the outlet 46.

According to the invention, the rocker arm chamber 17 and the push rod chamber 15 both can serve as oil-separating chambers of wide width with an enhanced separation capability leading to the reduction of lubricating oil consumption. In addition, the elimination of the need for providing an extra breather chamber in the rocker arm chamber 17 etc. simplifies the structure as well as lowers the production cost. A large quantity of oil separated in the push rod chamber 15 is supplied to the bearing portions of the crank shaft 1 and returned back into the crank chamber 25 through the paths such as the groove 20, which enables the bearings for the crank shaft 1 to be always lubricated with fresh lubricating oil for prevention of lubrication failure. With the overhung crank type, the first invention can be effectively adapted for the PTO side which otherwise would be exposed to a severe lack of lubrication.

According to the second invention, a provision of the exhaust hole (the outlet 46) in the push rod chamber 15 for breathing gas permits blowby gas to be drawn from such a place free from being stirred by the rocker arms 42 etc. as the push rod chamber 15, which realizes an idealistic separation of oil, thus minimizing an adverse effect on the intake system to process breather gas. In addition, the more oil separated in the push rod chamber 15, the more oil supplied to the bearings, thus enhancing lubrication performance.

For a path to connect the oil reserviors 22 and 24, a small clearance between the journal portion 3 and the bush 4 can work, if the groove 20 is eliminated. Additionally, the invention can also apply to the center crank type engine, let alone the cam gear type engine other than the cam gearless type (CGL) engine as shown in the figure. With an overhung crank type engine containing a reduction gear in the crank shaft portion, two or more bearings are set on one side of one of the crank arms, so that a structure can be adopted where: as shown in FIG. 1, a bearing far from the crank arm 29 is lubricated first, and then a bearing close thereto is lubricated by the remaining oil.

It will be obvious to those skilled in the art that various changes may be made to the invention without departing from the spirit and scope thereof and therefore the invention is not limited by that which is shown in the drawing and described in the specification but only as indicated in the appended claims.

What is claimed is:

1. A lubricating device for an overhead valve engine having a rocker arm chamber provided with a valve gear, a crank chamber provided with a valve driving gear, and valve drive push rods disposed between the valve gear and the valve driving gear, comprising:

paths respectively communicating said crank chamber to said rocker arm chamber, said rocker arm chamber to said push rod chamber, and the bottom of said push rod chamber to said crank chamber through a bearing portion on a power takeoff side.

2. A lubricating device for an overhead valve engine as claimed in claim 1, wherein said overhead valve engine is of an overhung crank type.

3. A lubricating device for an overhead valve engine having a rocker arm chamber provided with a valve gear, a crank chamber provided with a valve driving gear, a valve drive push rods disposed between the valve gear and the valve driving gear, comprising:

paths respectively communicating said crank chamber to said rocker arm chamber, said rocker arm chamber to said push rod chamber, and the bottom of said push rod chamber to a bearing portion on a power takeoff side, and an outlet for breather gas in said push rod chamber.

4. A lubricating device for an overhead valve engine as claimed in claim 3, wherein said overhead valve engine is of an overhung crank type.

* * * * *